US005597298A

United States Patent [19]

Snyder et al.

[11] Patent Number: 5,597,298

[45] Date of Patent: Jan. 28, 1997

[54] LAMINAR FLOW BURNER

[75] Inventors: William J. Snyder, Ossining; Maynard G. Ding, Yorktown; Richard T. Semenza, Shrub Oak, all of N.Y.; Johnny D. Jackson, Sandy Hook, Conn.

[73] Assignee: Praxair Technology, Inc., Danbury, Conn.

[21] Appl. No.: 355,129

[22] Filed: Dec. 13, 1994

[51] Int. Cl.[6] ..... F23C 5/00

[52] U.S. Cl. ..... 431/8; 431/187; 239/423

[58] Field of Search ..... 431/8, 9, 10, 187, 431/188, 349, 184, 181; 239/423, 424, 424.5

[56] References Cited

U.S. PATENT DOCUMENTS

| | | | |
|---|---|---|---|
| 4,645,449 | 2/1987 | Schwartz et al. | 431/8 |
| 4,878,829 | 11/1989 | Anderson | 431/8 |
| 4,907,961 | 3/1990 | Anderson | 431/8 |
| 5,100,313 | 3/1992 | Anderson et al. | 431/8 |
| 5,110,285 | 5/1992 | Snyder et al. | 431/8 |
| 5,199,866 | 4/1993 | Joshi et al. | 431/187 |
| 5,209,656 | 5/1993 | Kobayashi et al. | 431/187 |
| 5,267,850 | 12/1993 | Kobayashi et al. | 431/8 |
| 5,295,816 | 3/1994 | Kobayashi et al. | 431/9 |

*Primary Examiner*—James C. Yeung
*Attorney, Agent, or Firm*—Stanley Ktorides

[57] ABSTRACT

An oxidant injector for a burner having a nozzle with a surface prescribing a continuous function enabling laminar flow of secondary oxidant over the nozzle surface which functions simultaneously to take heat off, and to prevent exothermic free radical recombinations from occurring proximate, the nozzle surface.

4 Claims, 1 Drawing Sheet

LAMINAR FLOW BURNER

TECHNICAL FIELD

This invention relates to oxidant injectors or lances for burners which can operate with high oxygen oxidant. The invention enables the use of such burners without the need for water cooling.

BACKGROUND ART

High oxygen oxidant is being increasingly employed in carrying out combustion in industrial furnaces such as steelmaking furnaces and aluminum making furnaces. High oxygen oxidant is a mixture comprising at least 30 volume percent oxygen and preferably comprising at least 80 volume percent oxygen. High oxygen oxidant also includes commercially pure oxygen which has an oxygen concentration of 99.5 volume percent or more. Combustion carried out with high oxygen oxidant is more fuel efficient than combustion carried out with air because much less energy is used to process and heat nitrogen which comprises nearly 80 volume percent of air. Moreover, combustion carried out with high oxygen oxidant has environmental advantages because less nitrogen is available to the combustion reaction to react with oxygen to form nitrogen oxides (NOx) which are considered to be significant environmental pollutants.

Combustion carried out with high oxygen oxidant is generally characterized by a higher combustion reaction temperature than would be the case if air were used as the oxidant. The high combustion reaction temperature can damage or reduce the life of the burner nozzle. Moreover, these higher combustion temperatures produce a large percentage of free radicals such as O, OH and H, in the flame zone. If these free radicals come in contact with a surface, they recombine and release significant amounts of heat in the process. If the burner nozzle does not have adequate heat removal, it can be overheated and damaged which could reduce the life of the nozzle.

One way to reduce such burner nozzle damage is to cool the burner and the nozzle with water or some other liquid coolant. However, such water cooling is complicated to carry out, increases the possibility of corrosion of burner parts, and raises the danger that the water could leak and damage the furnace and the furnace charge such as steel, aluminum, etc.

Accordingly it is an object of this invention to provide an oxidant injector or lance for a burner which can operate with high oxygen oxidant and which does not require the use of water cooling to avoid damage to the burner nozzle.

It is another object of this invention to provide a combustion method which can employ high oxygen oxidant without the need for water cooling the oxidant injection nozzle.

SUMMARY OF THE INVENTION

The above and other objects, which will become apparent to those skilled in the art upon a reading of this disclosure, are attained by the present invention, one aspect of which is:

An oxidant provision means for a burner comprising:

(A) a central conduit;

(B) a nozzle attached to the central conduit, said nozzle having a surface extending axially past the central conduit and having at least one passage for passage of main oxidant from the central conduit through the nozzle; and (C) means for providing secondary oxidant over the surface of the nozzle, said nozzle surface prescribing a continuous function.

Another aspect of the invention is:

A method for carrying out combustion comprising:

(A) providing main oxidant into a combustion zone through an oxidant provision means comprising a central conduit and a nozzle attached to the central conduit, said nozzle having a surface extending axially past the central conduit and having at least one passage for passage of main oxidant from the central conduit through the nozzle;

(B) providing fuel into the combustion zone and combusting the main oxidant with the fuel in the combustion zone; and (C) providing secondary oxidant over the surface of the nozzle, said nozzle surface prescribing a continuous function, combusting secondary oxidant with fuel to form free radicals, forming a boundary layer of secondary oxidant between the nozzle surface and the free radicals, and keeping the free radicals from recombining on the nozzle surface by the boundary layer.

Another aspect of the invention is:

An oxidant provision means for a burner comprising:

(A) a central conduit;

(B) a nozzle attached to the central conduit, said nozzle having a surface extending axially past the central conduit and having at least one passage for passage of main oxidant from the central conduit through the nozzle;

(C) means for providing secondary oxidant over the surface of the nozzle, said nozzle surface having a discontinuity; and (D) means for providing counteracting oxidant from the central conduit through the nozzle to the nozzle surface at the discontinuity.

Another aspect of the invention is:

A method for carrying out combustion comprising:

(A) providing main oxidant into a combustion zone through an oxidant provision means comprising a central conduit and a nozzle attached to the central conduit, said nozzle having a surface extending axially past the central conduit and having at least one passage for passage of main oxidant from the central conduit through the nozzle;

(B) providing fuel into the combustion zone and combusting the main oxidant with the fuel in the combustion zone to form free radicals;

(C) providing secondary oxidant over the surface of the nozzle, said nozzle surface having a discontinuity, combusting secondary oxidant with fuel to form free radicals, and forming a boundary layer of secondary oxidant between the nozzle surface and the free radicals except at the discontinuity; and (D) providing counteracting oxidant from the central conduit through the nozzle to the nozzle surface at the discontinuity, and keeping the free radicals from recombining on the nozzle surface by the boundary layer and the counteracting oxidant.

As used herein the term "continuous function" means a nozzle surface such that the slope of the line tangent to a point on the surface is the same whether that point is approached from the direction of the gas flow along the nozzle surface or opposite the direction of the gas flow along the nozzle surface.

As used herein the term "discontinuity" means the point on a nozzle surface at which the slope of the line tangent to that point is different depending on whether that point is approached from the direction of the gas flow along the nozzle surface or opposite the direction of the gas flow along the nozzle surface.

DETAILED DESCRIPTION

The efficiency of a combustion reaction is influenced by the degree of mixing between the fuel and the oxidant to form the combustible mixture. Turbulence has heretofore been employed to enhance the thoroughness of the mixing of the fuel and oxidant. The invention incorporates the recognition that in a certain instance, i.e. when using high oxygen oxidant while seeking to avoid water cooling, laminar flow at the burner nozzle is better than turbulent flow so as to prevent the recombination of free radicals at the nozzle surface. Although mixing between the fuel and oxidant is much less thorough than if the flow over the nozzle were turbulent, the consequent reduction in the heat flux to certain points on the nozzle surface enables one to carry out the combustion without water cooling and yet still avoid damaging the nozzle.

The invention will be described in greater detail with reference to the Drawings.

Figure 1:
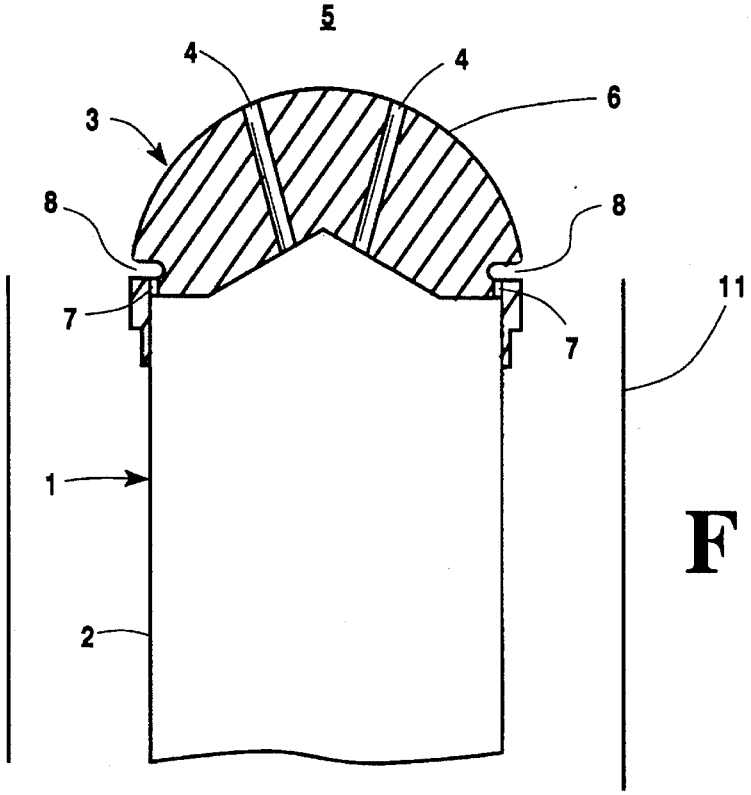
FIG. 1 is a simplified cross-sectional representation of one preferred embodiment of the invention wherein the nozzle surface prescribes a continuous function over its entire surface.

Referring now to FIG. 1 there is illustrated oxidant provision means 1 which comprises central conduit 2 and nozzle 3 attached thereto and extending axially past-the central conduit 2. The central conduit communicates with a source of high oxygen oxidant and, in operation, this high oxygen oxidant is passed through central conduit 2 and through one or more passages 4 through nozzle 3 as main oxidant into combustion zone 5 wherein it mixes with and combusts with fuel which is preferably provided into the combustion zone concentrically around the oxidant provision means such as through fuel provision means 11. The fuel may be any fluid fuel such as methane, propane or natural gas. The central conduit and the nozzle may be made out of any suitable high temperature materials such as for example, inconel or stainless steel. The nozzle will generally have essentially a hemispherical shape.

Secondary oxidant, which generally has the same composition as the main oxidant, is passed over the surface 6 of nozzle 3. Generally the secondary oxidant will comprise from 5 to 15 percent of the total oxidant employed, i.e. the sum of the main and secondary oxidants. In the embodiment illustrated in FIG. 1, the secondary oxidant is passed from central conduit 2 through passages or bleed lines 7 into nozzle indentation 8 from where it flows over the surface of nozzle 3. Any suitable number of passages 7 may be used in the practice of this invention. The secondary oxidant flowing over the surface of nozzle 3 serves as a shield or barrier between the heat in combustion zone 5 and nozzle 3.

The effectiveness of the secondary oxidant heat shield flow over the surface of nozzle 3 requires that this secondary oxidant heat shield flow be laminar to prevent the combustion flame front and the free radicals in the combustion zone from contacting the nozzle surface. The free radicals are mostly generated at the flame front at the interface between the secondary oxidant and the fuel. Turbulent flow, while still enabling heat to be taken off from the nozzle, will nevertheless cause heat to intensify at certain discrete areas on the nozzle surface causing heat induced damage to the nozzle at those points.

Secondary oxidant laminar flow over the nozzle surface is accomplished by having the nozzle surface prescribe a continuous function over the entire surface area where the secondary oxidant flows over the surface. That is, the relevant nozzle surface is smooth without any angles or corners. For example, as illustrated in FIG. 1, the surface proximate indentation 8 is rounded rather than being sharply defined as would be the case with conventional machining practice. In the embodiment of the invention illustrated in FIG. 1, the relevant nozzle surface is the area downstream of, or defined by, indentation 8.

The flow of secondary oxidant over the surface of the nozzle serves to take heat off and away from the nozzle. In addition, the laminar nature of this secondary oxidant flow establishes a thick boundary layer between the nozzle and the heat in the combustion zone keeping the free radicals from recombining on the nozzle surface. These two effects, cooling flow and the thick boundary layer, work in concert to enable the carrying out of the combustion using high oxygen oxidant without the need for water cooling.

Figure 2:
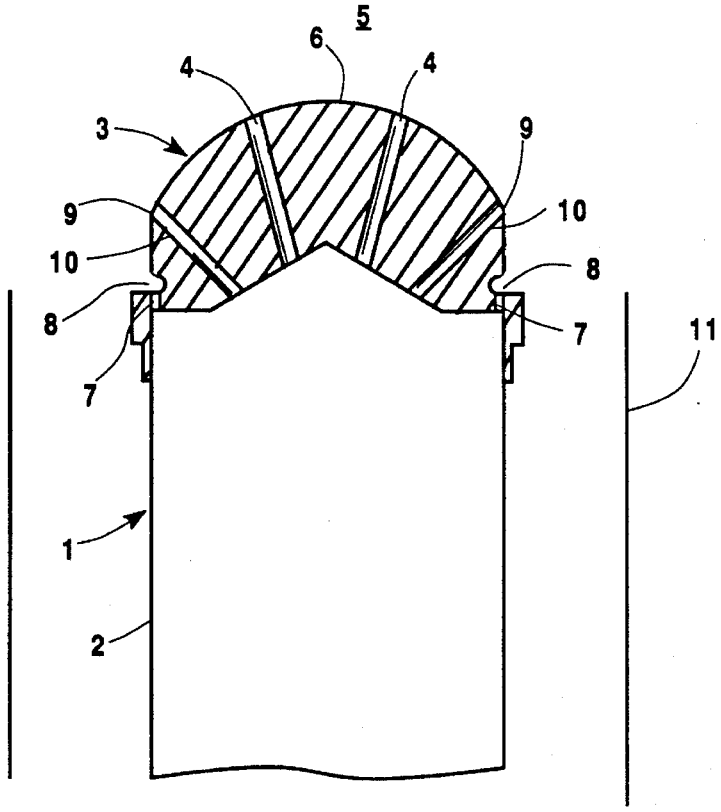
FIG. 2 is a simplified cross-sectional representation of another embodiment of the invention wherein the nozzle surface has a discontinuity.

In some situations a discontinuity on the nozzle surface cannot be avoided. Such a situation is illustrated in FIG. 2. The embodiment of the invention illustrated in FIG. 2 operates in much the same manner as that illustrated in FIG. 1 and the common points of operation will not be described again. The numerals in FIG. 2 correspond to those of FIG. 1 for the common elements.

In the embodiment illustrated in FIG. 2, the side of the nozzle has been sliced off establishing discontinuities at points 9. Turbulence would be expected to form proximate the discontinuities 9 because the non-smooth nozzle surface at these points would disrupt the flow of secondary oxidant flowing past these points and cause it to be non-laminar at these discontinuities. This turbulence would bring free radicals from the combustion zone onto the nozzle surface causing a hot spot and eventual damage to the nozzle at these points. This situation is avoided or its effect reduced by providing one or more passages 10 through nozzle 3 connecting conduit 2 with one or more of the discontinuities 9. Oxidant flowing through passage 10 at the nozzle surface serves to counteract the hot spot effect caused by the turbulence at the discontinuity by providing additional cooling to said area and works with the boundary layer of secondary oxidant to keep the free radicals from recombining on the nozzle surface. Passage 10 may conveniently be a main oxidant passage if the discontinuity on the nozzle surface is at a proper location for the counteracting oxidant passing through passage 10 to also serve as combustion oxidant for the combustion within combustion zone 5. As a practical matter it may not be possible to provide counteracting oxidant to every discontinuity on the nozzle surface. Like the main oxidant and the secondary oxidant, the counteracting oxidant is high oxygen oxidant.

Now, with the use of this invention, one can use high oxygen oxidant to carry out combustion without the need for water cooling to protect important burner parts. Although the invention has been described in detail with reference to certain embodiments, those skilled in the art will recognize that there are other embodiments of the invention within the spirit and the scope of the claims.

We claim:

1. An oxidant provision means for a burner comprising:

(A) a conduit;

(B) a nozzle attached to the conduit having a surface and at least one passage for passage of main oxidant from the conduit through the nozzle to the nozzle surface; and (C) an indentation on the nozzle surface having a rounded surface, and a passage connecting the indentation with the conduit.

2. A method for carrying out combustion comprising:

(A) providing main oxidant into a combustion zone through an oxidant provision means comprising a conduit and a nozzle attached to the conduit having a surface and at least one passage for passage of main oxidant from the conduit through the nozzle and into the combustion zone;

(B) providing fuel into the combustion zone and combusting the main oxidant with the fuel in the combustion zone; and (C) providing secondary oxidant over the surface of the nozzle in a laminar flow, combusting secondary oxidant with fuel to form free radicals, forming a boundary layer of secondary oxidant between the nozzle surface and the free radicals, and keeping the free radicals from recombining on the nozzle surface by the boundary layer.

3. An oxidant provision means for a burner comprising:

(A) a conduit;

(B) a nozzle attached to the conduit having a surface, at least one passage for passage of main oxidant from the conduit through the nozzle, and having a non-smooth point on the nozzle surface; and (C) passage means for providing counteracting oxidant from the conduit through the nozzle to the nozzle surface at the non-smooth point.

4. A method for carrying out combustion comprising:

(A) providing main oxidant into a combustion zone through an oxidant provision means comprising a conduit and a nozzle attached to the conduit having a surface and at least one passage for passage of main oxidant from the conduit through the nozzle into the combustion zone;

(B) providing fuel into the combustion zone and combusting the main oxidant with the fuel in the combustion zone;

(C) providing secondary oxidant over the surface of the nozzle, said nozzle surface having a, non-smooth point, combusting secondary oxidant with fuel to form free radicals, and forming a boundary layer of secondary oxidant between the nozzle surface and the free radicals except at the non-smooth point; and (D) providing counteracting oxidant from the conduit through the nozzle to the nozzle surface at the non-smooth point, and keeping the free radicals from recombining on the nozzle surface by the boundary layer and the counteracting oxidant.

* * * * *